US010156215B2

(12) United States Patent
Owen et al.

(10) Patent No.: US 10,156,215 B2
(45) Date of Patent: Dec. 18, 2018

(54) MANIFOLD ASSEMBLY

(71) Applicant: GM GLOBAL TECHNOLOGY OPERATIONS LLC, Detroit, MI (US)

(72) Inventors: Shawn W. Owen, Ortonvile, MI (US); Travis Sperow, Davisburg, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 56 days.

(21) Appl. No.: 15/237,943

(22) Filed: Aug. 16, 2016

(65) Prior Publication Data

US 2018/0051662 A1 Feb. 22, 2018

(51) Int. Cl.

| | |
|---|---|
| ***F02M 35/104*** | (2006.01) |
| ***F02M 35/10*** | (2006.01) |
| *F02M 35/112* | (2006.01) |

(52) U.S. Cl.

CPC .... *F02M 35/104* (2013.01); *F02M 35/10268* (2013.01); *F02M 35/10321* (2013.01); *F02M 35/10144* (2013.01); *F02M 35/112* (2013.01)

(58) Field of Classification Search

CPC ..... F02M 35/10314; F02M 35/104; F02M 35/112; F02M 35/10144

See application file for complete search history.

(56) References Cited

U.S. PATENT DOCUMENTS

| | | | | |
|---|---|---|---|---|
| 4,141,673 | A * | 2/1979 | McCormick | F02B 75/06 416/157 R |
| 6,116,026 | A * | 9/2000 | Freese, V | F02B 29/0462 123/568.12 |
| 2006/0016416 | A1* | 1/2006 | Kim | F02M 35/10072 123/184.61 |
| 2014/0069085 | A1* | 3/2014 | Alm | F02D 9/04 60/274 |
| 2014/0116395 | A1* | 5/2014 | Blackstock | F02B 75/041 123/48 R |

* cited by examiner

*Primary Examiner* — Jacob Amick
*Assistant Examiner* — Charles Brauch

(57) ABSTRACT

A manifold assembly includes a clevis-style mounting structure, a first manifold section, a second manifold section, an accessory disposed between the first and second manifold sections, and a plurality of threaded clevis fasteners. The clevis-style mounting structure includes an upper clevis structure and a lower threaded clevis structure. The clevis-style mounting structure may be operatively configured to be mounted on a cylinder head. The first manifold section has distal and proximal ends. The first manifold section is integral to the clevis style mounting structure. The plurality of threaded clevis fasteners operatively configured to mount the clevis-style mounting structure to a cylinder head via a plurality of corresponding passageways defined in the cylinder head.

14 Claims, 5 Drawing Sheets

MANIFOLD ASSEMBLY

TECHNICAL FIELD

The present disclosure relates to engines, engine components, and more particularly, an intake manifold assembly.

BACKGROUND

An internal combustion engine is used to transfer the fuel (e.g. air and gasoline) to mechanical energy to operate an engine. A complete process of transferring the fuel to mechanical energy is called engine cycle. The operation of the engine commonly includes a plurality of engine cycles.

An engine cycle generally includes four strokes: intake, compression, power transformation and exhaust. Intake is for generating vacuum by the pressure difference to the atmosphere. Air is filtered, and the filtered air is pulled in by the vacuum; then the filtered air is mixed with a gasoline jetted by a nozzle in a cylinder block. Compression is for compressing; the mixed gasoline in the cylinder block. Power transformation is for burning the mixed gasoline to expand the volume thereof, thereby pushing the piston to generate mechanical energy. Exhaust is for exhaling the waste gasoline from the cylinder block. For increasing the performance of the cylinder block, the burning efficiency of the gasoline should be increased. Therefore, it is very important to control or increase the air flow.

In a conventional injection type internal combustion engine, the open level of the intake throttle valve is increased with the pressing amount of the accelerator pedal. Greater depression of the accelerator pedal, promotes higher open level of the intake throttle valve, and therefore larger amounts of air pulled in. When the amount of air pulled in is greater, an air flow sensor is used to detect the air flow, and the detecting results will be transferred to a gasoline-injecting controlling system, then more amount of gasoline will be injected to increase air-fuel ratio, thereby the efficiency of the internal combustion engine will be increased. However, the conventional air flow sensor has time error from detecting to sensing so that the detecting data is not accurate. Thus, the amount of real air flow will be smaller than the amount that is required to be mixed with the gasoline. Moreover, a time error will also be occurred when the air flows in, thereby lowering air-fuel ratio.

The aforementioned situations usually occur when the vehicle starts from rest state or starts from a lower vehicle speed to a higher vehicle speed. When the accelerator pedal is pressed to increase the vehicle speed, the vehicle may tremble or the vehicle will be stuck. Furthermore, in an environment having thin air, the amount of the air flow is not enough, therefore air-fuel ratio is low, and thus the power of the inner combustion engine is low, thereby lowering the climbing ability of the vehicle.

A turbo boosted type internal combustion engine which uses a turbocharger 56 may now be used in vehicles in the marketplace. The operation principle for turbo boost engines is that the boost type internal combustion engine is to use the exhaust air to drive a turbine blade, and the air compressor disposed in one end of the turbine axis is used to compress the air that enters the compressed air, and is provided to the inner combustion engine for burning. However, when compressing the incoming air for use in the combustion system, the air temperature is greatly increased causing less combustion efficiencies.

Intercooler 42 shown in FIG. 2 are accordingly implemented when a turbocharger is used in the engine assembly.

The intercooler 42 is a heat exchanger that is used to cool air that has been compressed by either a super-charger or a turbocharger for the engine. The intercooler 42 is generally placed somewhere in the path of air that flows from the turbo/supercharger to the motor, and is typically a separate unit adjacent to the engine as shown in FIG. 2. An intercooler 42 is needed because it is undesirable to have excessively hot air used in an engine 38 given that hot air is less dense and therefore contains less molecules of oxygen per unit volume. Accordingly, there is less air for the motor in a given stroke and less power produced. Moreover, hot air also causes a higher cylinder temperature which can aid in pre-detonation of the combustion cycle which results in inefficient engine operations. Accordingly, it is desirable to provide an intercooler 42 for engines using turbochargers in order reduce the intake air temperature.

The mounting of a traditional intake manifold assembly 36 to an engine typically is comprised of several steel brackets, fasteners, or other joining structures such as hooks or clamps as shown in FIG. 1. The use of several intermediate components which attach on one side to the engine cover and on the other side to an engine component (e.g., an air intake manifold or a cam cover) creates many potential sites for NVH (noise, vibration, and harshness) problems such as squeak and rattle. Moreover, given that a traditional intake manifold assembly 36 generally requires fasteners 40 to be implemented at fastener sites 50 at both upper and lower sides of cylinder head 52 (as shown in FIG. 1), it may be particularly challenging for an assembly worker to access the lower fastening areas for the traditional intake manifold 36 due to small clearances between the engine parts. Moreover, the use of mechanical fasteners 40 usually means at least two fastening components are implemented on each of the upper and lower fastening sites for the intake manifold assembly onto the engine 38. The relatively large part count leads to added part costs and an associated increase in manufacturing time as well as assembly costs.

The air intake manifold which directs incoming air to the respective engine cylinders of a combustion engine has historically been fabricated from metal. More recently, various molded materials including thermoplastics, resins, and polymers have been used to manufacture intake manifolds. Preferred materials may include nylon or other polyamides which may further include filler materials such as glass fibers. A switch to plastic materials has achieved a reduction in weight, but reliance on brackets and fasteners with a high parts count have continued which enhances cost and assembly time.

SUMMARY OF THE INVENTION

The present disclosure provides a manifold assembly for an internal combustion engine for vehicle use. The manifold assembly may, but not necessarily be a manifold assembly. The manifold assembly includes a clevis-style mounting structure, a first manifold section, a second manifold section, an optional accessory disposed between the first and second manifold sections, and a plurality of threaded fasteners. The clevis-style mounting structure includes an upper clevis structure and a lower clevis structure. The clevis-style mounting structure may be operatively configured to be mounted on a cylinder head. The first manifold section has distal and proximal ends. The first manifold section is integral to the clevis style mounting structure. The plurality of threaded fasteners operatively configured to affix the clevis-style mount structure to a cylinder head via a plurality of corresponding passageways defined in the cylinder head.

The invention and its particular features and advantages will become more apparent from the following detailed description considered with reference to the accompanying drawings.

BRIEF DESCRIPTION OF THE DRAWINGS

These and other features and advantages of the present disclosure will be apparent from the following detailed description of preferred embodiments, and best mode, appended claims, and accompanying drawings in which:

Like reference numerals refer to like parts throughout the description of several views of the drawings.

DETAILED DESCRIPTION

Figure 1A:
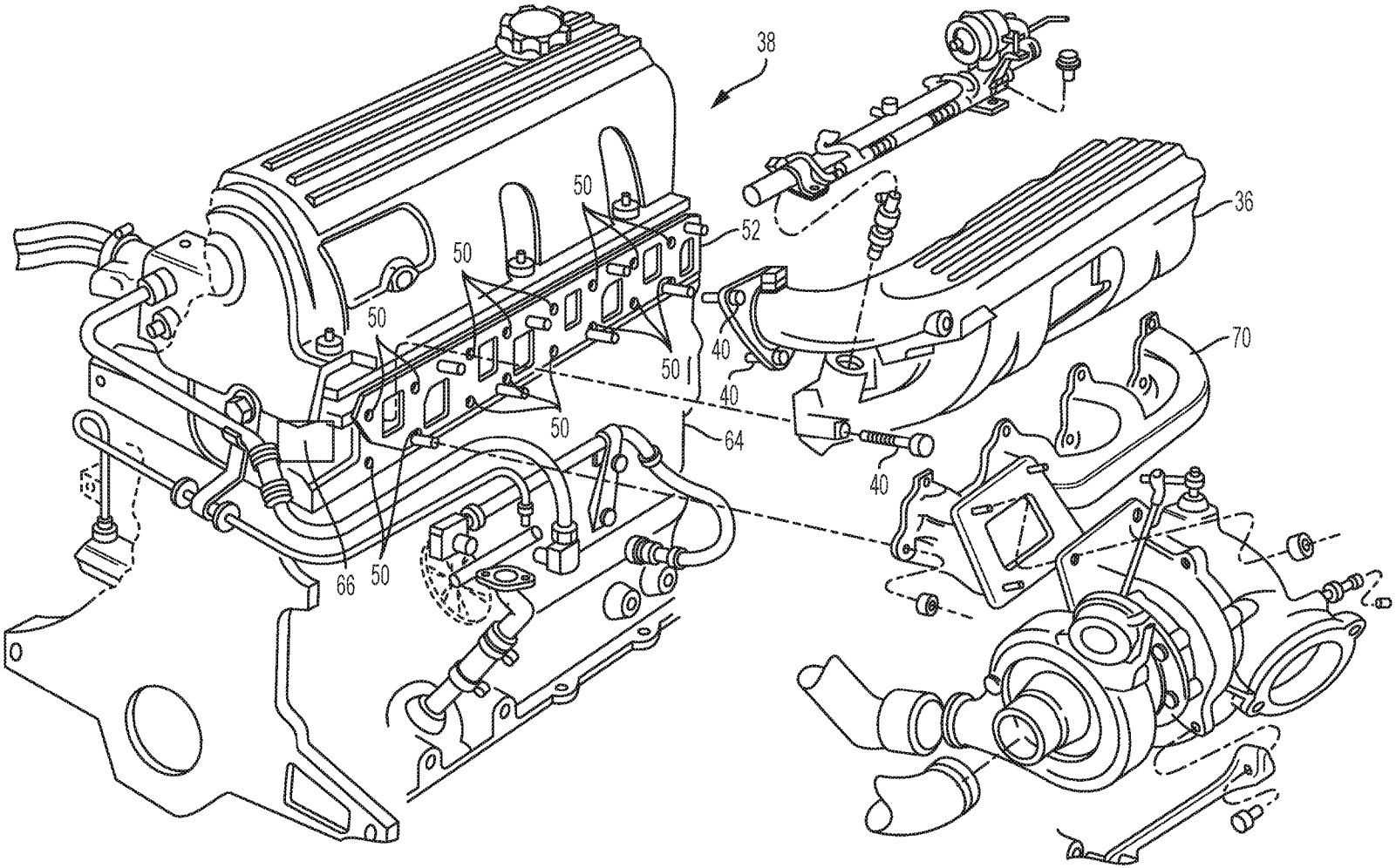
FIG. 1A (PRIOR ART)
FIG. 1A is an expanded, perspective view of a traditional engine having a traditional intake manifold.

The exemplary embodiments described herein provide detail for illustrative purposes, and are subject to many variations in composition, structure, and design. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein are for the purpose of description and should not be regarded as limiting.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced items.

The present disclosure provides for a manifold assembly 10. The manifold assembly may, but not necessarily be an intake manifold assembly. In certain engine configurations, the manifold assembly 10 may be an exhaust manifold assembly. In a first aspect, the present disclosure provides a mounting arrangement 22 which eliminates multiple threaded fasteners, straight-line run-down clearance requirements for assembly where the region perpendicular to the mounting surface must generally remain free of any obstructions in order to install the many fasteners for the manifold. The clevis style mounting arrangement 22 for the manifold requires minimal threaded fasteners along its length. The distal region of the cylinder head 20 is operatively configured to engage with a clevis-style structure from the manifold and further defines a passageway 28 which is operatively configured to receive the threaded clevis style fasteners 14.

The upper clevis structure 24 is the portion of the clevis structure which substantially spans the upper side of the cylinder head 20. The lower clevis structure 26 is the portion of the clevis structure which substantially spans the lower side of the cylinder head 20. As shown, clevis-style structure defines 30 near the upper side and lower side of the manifold which are aligned with a corresponding passageway 28 defined in the cylinder head 20 so that the threaded fastener 14 may be received within the corresponding apertures 30 and the aligned passageway 28 for that particular threaded fastener or thread insert.

It is further understood that each opening 30 in the lower clevis structure 26 defines threads 34 which engage with the bottom portion 32 of each corresponding threaded fastener 14. The manifold is formed from polymeric material. The threads 34 implemented in lower clevis structure 26 and the lower clevis structure itself 26 are sufficiently strong and rigid to engage with each threaded fastener 14 as each threaded fastener 14 is rotated and secured within each thread 34. The lower clevis structure 26 can be easily mounted and secured to the distal portion of the cylinder head 20 by assembling the lower clevis structure 26 around and in place on the distal region 18 of the cylinder head 20.

The arrangement of the mounting structure 22 enables an assembly worker to mount the manifold 16 and thread the fasteners 14 into the lower clevis structure 26 from the upper clevis structure 24 area alone given that the lower clevis structure 26 is sufficiently rigid to stay in place while the threaded clevis fastener 14 is rotated into the threads 34. Therefore, this manifold assembly 10 design prevents an assembly worker from having to physically access the underside of the manifold where clearances are otherwise typically limited which increases assembly time and may further require more fasteners.

Accordingly, the number of fasteners may effectively be reduced as much as 50% in that a threaded clevis fastener 14 may be used to secure the manifold at both the upper side and the lower side of the cylinder head 20. As shown, thread inserts 34 are pressed into the lower clevis structure 26. Given that this new mounting arrangement 22 eliminates the need for a user to access the lower clevis structure 26, the manifold may now incorporate additional components such as a charge air cooler, or the like with the manifold 10. These additional incorporated components increase the size of the manifold and therefore, hinder access to the underside of the intake manifold. Thus, the present disclosure eliminates the need to access the underside of the manifold in order to install the manifold thereby which enables increasing the manifold size (which may block the traditional access points on the underside of the intake manifold).

Figure 2:
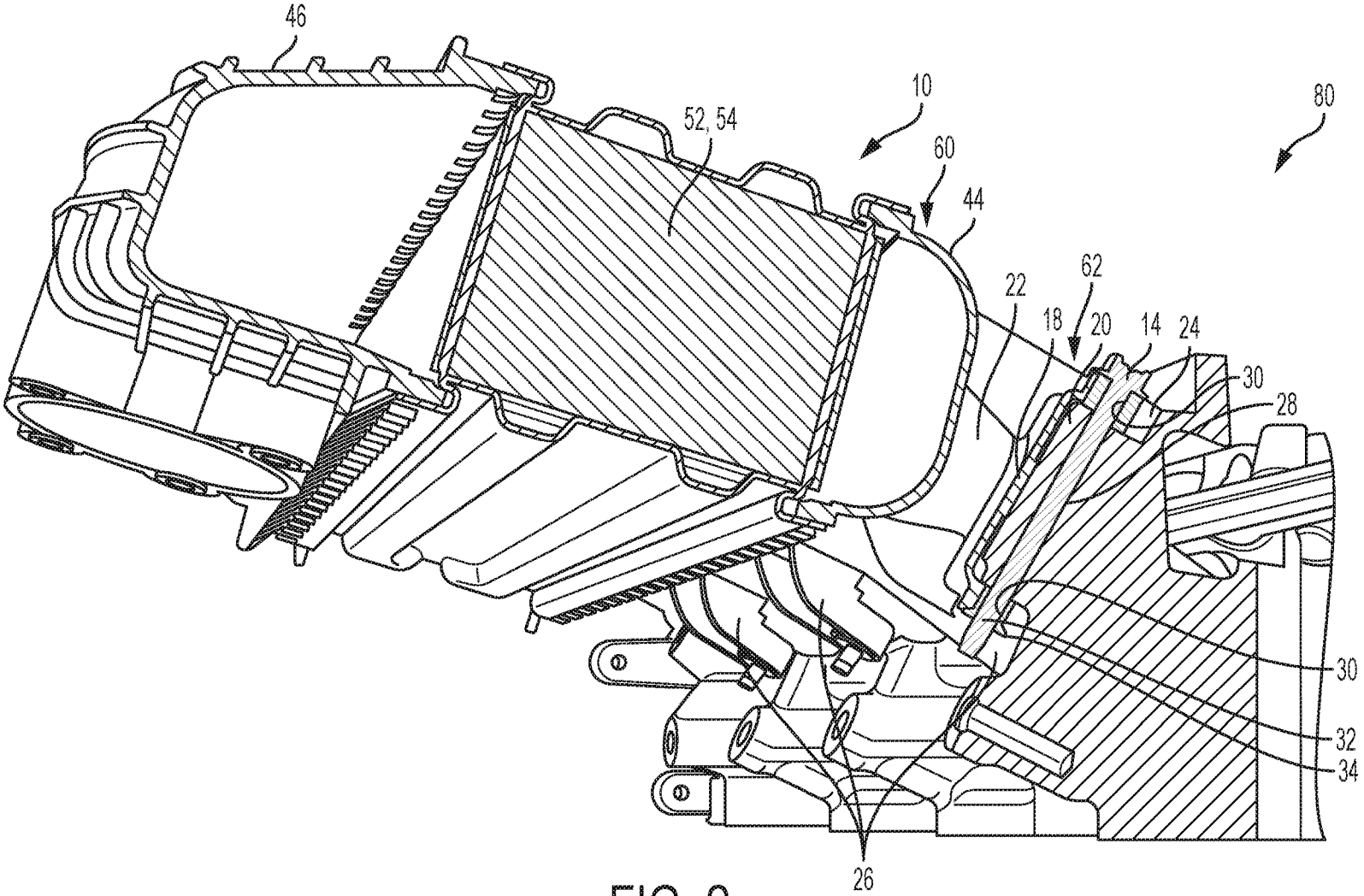
FIG. 2 is an isometric cross-sectional view of an embodiment of the present disclosure.

As shown in FIG. 2, present disclosure utilizes threaded clevis fasteners 14 which are parallel to the mounting surface and in between the intake ports. Accordingly, the orientation of the threaded clevis fasteners 14 are parallel to the mounting surface, rather than typical perpendicular orientation. Accordingly, an example, non-limiting embodiment of an integrated charge air cooler 54 in an intake manifold assembly 10 according to the present disclosure includes a clevis-style mounting structure, a first intake manifold section 44, a second intake manifold section 46, an accessory 52 disposed between the first and second intake manifold sections, and a plurality of threaded clevis fasteners 14. As shown, the accessory may be mounted to the distal end 60 of the first intake manifold section 44. The clevis-style mounting structure includes an upper clevis structure 24 and a lower clevis structure 26. The clevis-style mounting structure may be operatively configured to be mounted on a cylinder head 20. The first intake manifold section has a distal end 60 and proximal end 62. The first intake manifold section is integral to the clevis style mounting structure. The plurality of threaded clevis fasteners operatively configured to mount the clevis-style mounting structure to a cylinder head 20 via a plurality of corresponding passageways (such as through holes) 28 defined in the cylinder head 20.

Figure 3:
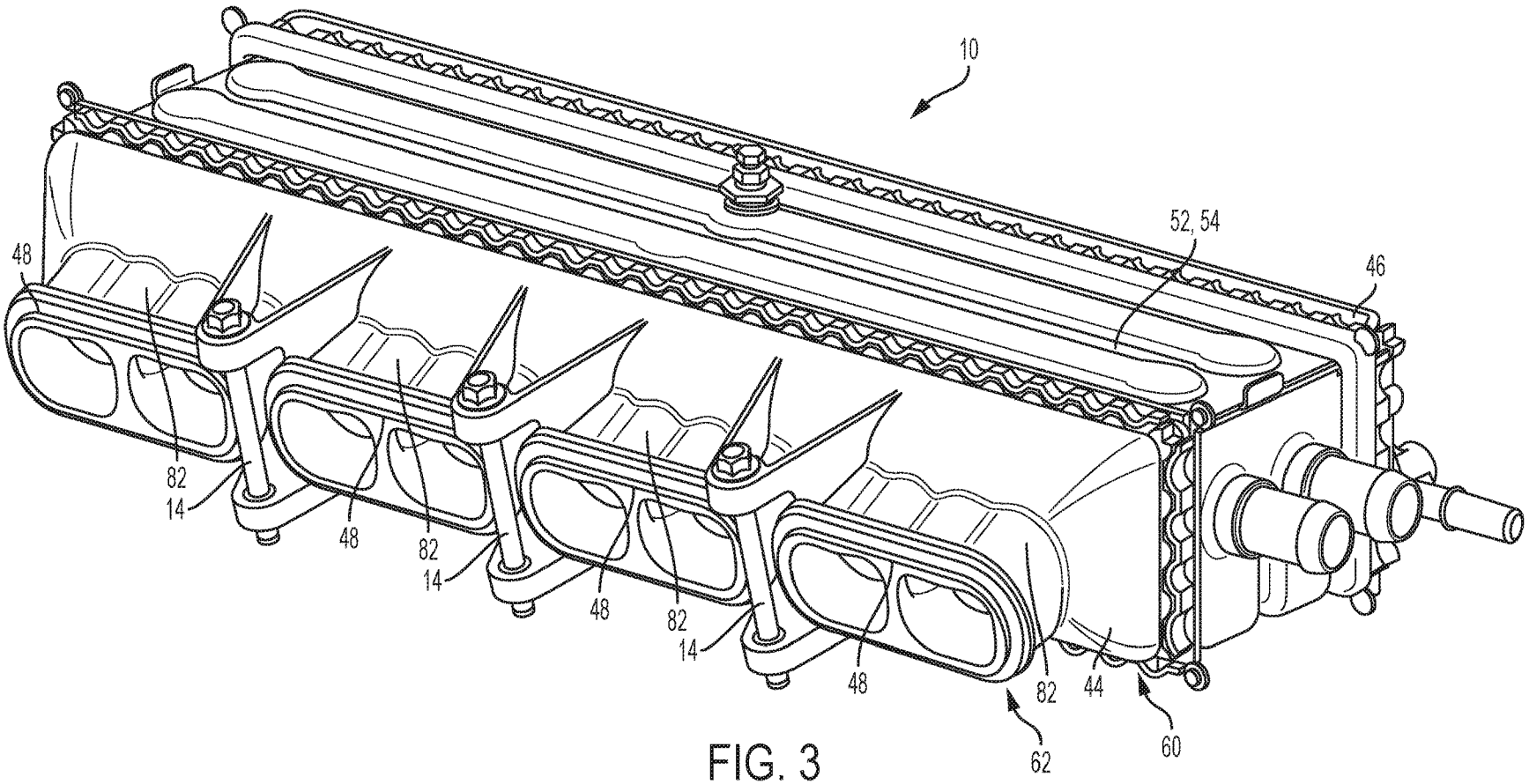
FIG. 3 is an isometric view of a manifold assembly in accordance with embodiments of the present disclosure.
Figure 4:
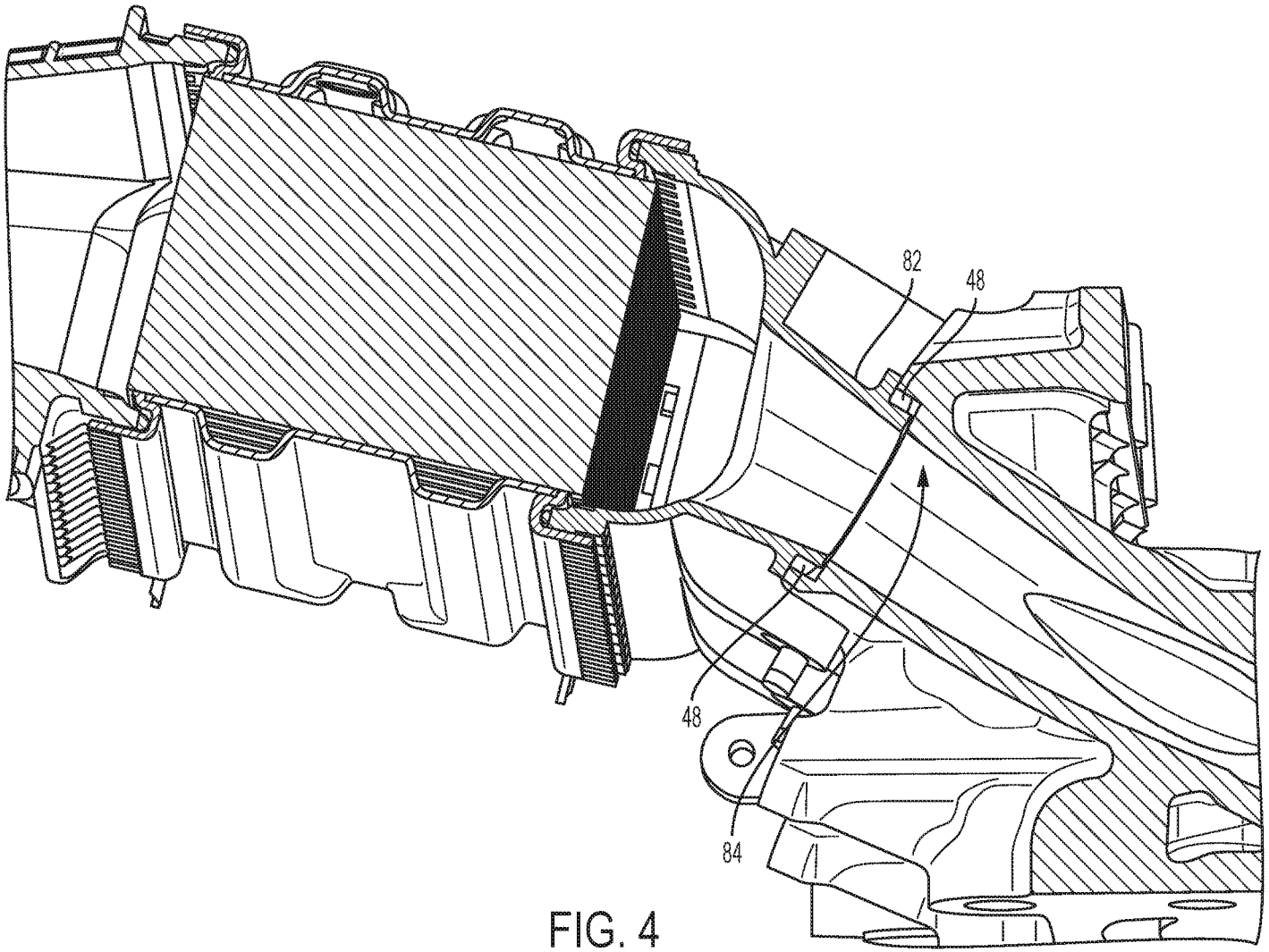
FIG. 4 is a side cross-sectional view of a manifold assembly in accordance with an embodiment of the present disclosure.

With reference to FIGS. 3 and 4, radial seals 48 may be used and be provided as part of the intake manifold assembly as shown. Given that the fastener load is applied in a plane which is parallel to the mounting flange, surface or face of the cylinder head, radial seals 48 may be used to seal the manifold intake runners 82 to cylinder heads ports 84. As shown in FIG. 4, radial seal 48 is disposed between the cylinder head 20 and manifold intake runner 82.

Accordingly, the intake manifold assembly 10 enables the packaging of components in closer proximity to the intake/cylinder head mating surface, which was traditionally not possible due to the use of conventional mounting system where the threaded fasteners 14 were mounted perpendicular to the mounting plate on both the upper portion 21 of the cylinder head 20 and lower portion 23 of the cylinder head 20. The intake manifold assembly 10 of the present disclosure may include, but not are limited to, a larger air plenum, various air runner shapes, sizes, amounts, indirect charge-air coolers.

Figure 1B:
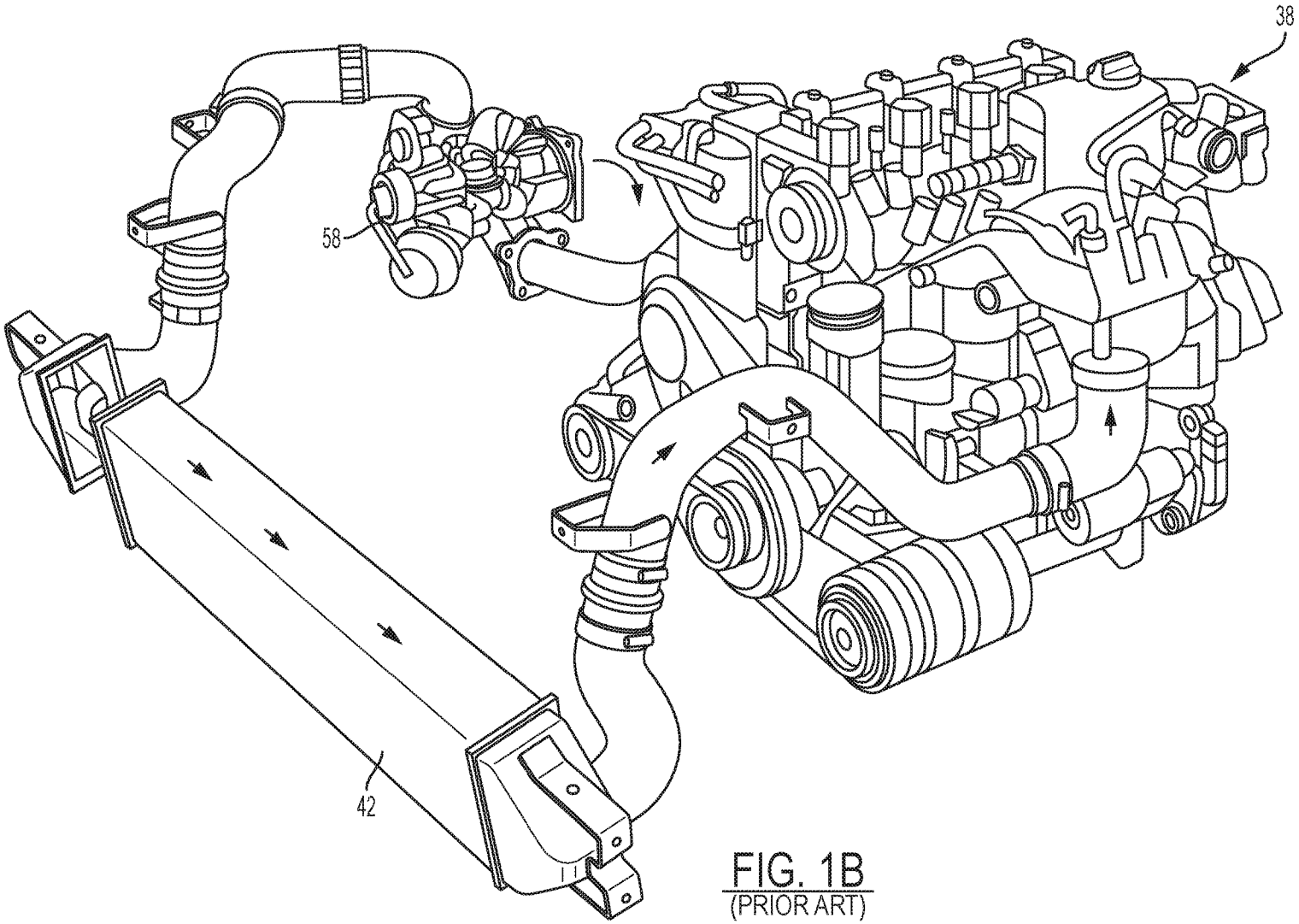
FIG. 1B (PRIOR ART)
FIG. 1B is an expanded, isometric view of a traditional engine having a traditional intercooler disposed proximate to the engine block.

Accordingly, an engine 80 (shown in FIG. 2) may be provided wherein the engine 80 includes an intake manifold 10 having a clevis style mounting structure 12 may mounted on a cylinder head 20 which may be affixed to an engine block (shown as 64 in FIG. 1). The engine block 64 may be adapted to receive a plurality of movable cylinders (shown schematically as 66 in FIG. 1). An exhaust manifold (shown as 70 in FIG. 1) may also be fastened to the engine 80. The intake manifold 10 mounted on engine 80 includes a first intake manifold section 44 integral to the clevis style mounting structure 12. The first intake manifold section 44 includes a proximal end 62 and a distal end 60. An accessory 52 (charge air cooler 54) may be affixed to the distal end 60 of the first intake manifold section 44. A second intake manifold section 46 may be affixed to the accessory 52 opposite the first intake manifold section 44. The accessory 52, may but not necessarily, be affixed to the first and second intake manifold sections via a crimped joint as shown. A plurality of threaded fasteners 14 may be operatively configured to mount the clevis-style mounting structure to the cylinder head via a plurality of corresponding passageways 28 defined in the cylinder head 20.

Given that additional features may be added to the intake manifold assembly 10 in a more direct route, the airflow path to the engine is shortened and therefore more efficient thereby providing an improved throttle response. Moreover, the integration of components results in reduced overall system mass and cost. Cost savings may be achieved in a variety of ways such as but not limited to elimination of fastener componentry, elimination of typical cylinder head multiple mounting bosses, as well as elimination of drill and tap features. Furthermore, in light of the implementation of fewer fasteners, the assembly burden is reduced via shorter assembly times and lower cost While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A manifold assembly comprising:

a clevis-style mounting structure having a c-shaped configuration operatively configured to be mounted on a cylinder head, the clevis-style mounting structure having an upper clevis structure and a lower clevis structure;

a first manifold section integral to the clevis style mounting structure, the first manifold section having a proximal end affixed to the cylinder head and a distal end extending away from the cylinder head;

an accessory affixed to the distal end of the first manifold section;

a second manifold section coupled to the first manifold section via the accessory disposed between the first and second manifold sections; and a plurality of fasteners operatively configured to mount the clevis-style mounting structure to a cylinder head via a plurality of corresponding passageways defined in the cylinder head, each fastener in the plurality of fasteners being disposed in the upper clevis structure, the lower clevis structure and the cylinder head being disposed between the lower and upper clevis structures, and the plurality of fasteners being substantially perpendicular to a manifold intake runner.

2. The manifold assembly as defined in claim 1 wherein the upper clevis structure being operatively configured to span along an upper portion of the cylinder head and the lower clevis structure being operatively configured to span along a lower portion of the cylinder head.

3. The manifold assembly as defined in claim 1 wherein the accessory is a charge air cooler.

4. The manifold assembly as defined in claim 1 further comprising a plurality of radial seals mounted to the first manifold section.

5. The manifold assembly as defined in claim 2 wherein each of the upper and lower clevis structures define apertures which align with the corresponding passageway in the cylinder head.

6. The manifold assembly as defined in claim 2 wherein the first manifold section is formed from polymeric material.

7. A manifold assembly comprising:

a clevis-style mounting structure having an upper clevis structure and a lower clevis structure in a c-shaped configuration, the clevis-style mounting structure operatively configured to be mounted on a cylinder head;

a first manifold section integral to the clevis style mounting structure, the first manifold section having a proximal end and a distal end; and a plurality of threaded fasteners operatively configured to mount the clevis-style mounting structure to a cylinder head via a plurality of corresponding passageways defined in the cylinder head, each fastener in the plurality of fasteners being disposed in the upper clevis structure, the cylinder head, the lower clevis structure with the cylinder head being disposed between the upper and lower clevis structures, and the plurality of threaded fasteners being substantially perpendicular to a manifold intake runner.

8. The manifold assembly as defined in claim 7 wherein the clevis-style mounting structure includes an upper clevis structure operatively configured to span along an upper portion of the cylinder head and a lower clevis structure operatively configured to span along a lower portion of the cylinder head, the upper clevis structure defines a plurality of upper apertures while the lower clevis structure defines a plurality of corresponding lower threaded apertures.

9. The manifold assembly as defined in claim 8 wherein the plurality of threaded clevis fasteners is configured to fasten the upper clevis structure and the lower clevis structure to the cylinder head via the plurality of upper apertures, the plurality of lower apertures and the plurality of corresponding passageways therebetween.

10. The manifold assembly as defined in claim 8 wherein the first manifold section is formed from polymeric material.

11. An engine comprising:

a plurality of movable cylinders;

an engine block operatively configured to receive the plurality of cylinders;

a cylinder head affixed to the engine block;

an exhaust manifold;

an intake manifold having a clevis-style mounting structure operatively configured to be mounted on a cylinder head, the clevis-style mounting structure having an upper clevis structure and a lower clevis structure;

and a plurality of fasteners configured to affix the intake manifold to the cylinder head, each fastener in the plurality of fasteners being disposed in the cylinder head, the upper clevis structure, and the lower clevis structure with the cylinder head being disposed between the upper and lower clevis structures, and the plurality of fasteners being substantially perpendicular to a manifold intake runner.

12. The engine as defined in claim 11 wherein the intake manifold further comprises:

a first manifold section integral to the clevis style mounting structure, the first manifold section having a proximal end and a distal end;

an accessory affixed to the distal end of the first manifold section; and a second manifold section affixed to the accessory opposite the first manifold section.

13. The engine as defined in claim 12 wherein the first and second manifold sections are affixed on each side of the accessory via a crimped joint.

14. The engine as defined in claim 13 wherein the first manifold section is formed from polymeric material.

* * * * *